US006647631B2

(12) United States Patent
So

(10) Patent No.: US 6,647,631 B2
(45) Date of Patent: Nov. 18, 2003

(54) CAN OPENER

(76) Inventor: Shun So, 2nd Floor, Chuan Yuan Factory Building 342-344, Kwun Tong Road, Kwun Tong, Kowloon (HK)

( * ) Notice: Subject to any disclaimer, the term of this patent is extended or adjusted under 35 U.S.C. 154(b) by 89 days.

(21) Appl. No.: 09/859,470

(22) Filed: May 18, 2001

(65) Prior Publication Data

US 2001/0042312 A1 Nov. 22, 2001

(30) Foreign Application Priority Data

May 19, 2000 (GB) ..... 0012204

(51) Int. Cl.[7] ..... B67B 7/46

(52) U.S. Cl. ..... 30/417; 30/418; 30/422; 30/426; 30/430

(58) Field of Search ..... 30/400, 409, 416, 30/417, 418, 422, 426, 425, 427, 430, 424, 434; D8/39, 41, 33

(56) References Cited

U.S. PATENT DOCUMENTS

| | | | | | |
|---|---|---|---|---|---|
| 1,393,412 | A | * | 10/1921 | Waller | 30/418 |
| 1,687,582 | A | * | 10/1928 | Noble | 30/418 |
| 1,759,364 | A | * | 5/1930 | Quigg | 220/275 |
| 2,677,175 | A | * | 5/1954 | Wild | 30/425 |
| 3,667,120 | A | * | 6/1972 | Krist | 30/425 |
| RE27,504 | E | * | 10/1972 | Smith | 30/418 |
| 5,581,897 | A | * | 12/1996 | Liebscher | 30/416 |
| 6,101,727 | A | * | 8/2000 | Chong | 30/417 |
| 6,148,527 | A | * | 11/2000 | Pereira | 30/417 |
| 6,182,368 | B1 | * | 2/2001 | So | 30/416 |

FOREIGN PATENT DOCUMENTS

GB 2289033 A * 11/1995

* cited by examiner

*Primary Examiner*—Allan N. Shoap
*Assistant Examiner*—Thomas J Druan, Jr.
(74) *Attorney, Agent, or Firm*—Leydig, Voit & Mayer, Ltd.

(57) ABSTRACT

A can opener includes a pair of handles, a traction wheel, and a cutter blade for removing a lid of a can. An operating knob is supported at one side of the can opener and rotates about an axis transverse to a central axis of a can being opened. The knob is coupled by step-down gearing to the traction wheel. For a left-handed user, the knob is mounted on the opposite side of the can opener.

10 Claims, 12 Drawing Sheets

CAN OPENER

The invention relates to a manually operable can opener which has a rotatable traction wheel and a rotatable cutter blade for lateral engagement with the rim or side wall of a metal can in order to cut open the can.

BACKGROUND OF THE INVENTION

Manually operable can openers have been known for many years and may be broadly categorised into three types: a first type having a cutter blade which cuts directly into the top wall of a can, a second type having a cutter blade which cuts into the side wall of the can below the rim, and a third type having a cutter blade which cuts partially into the rim of the can.

In the first type of can openers, the cutter blade has a rotational axis inclined to that of the traction wheel. The traction wheel and cutter blade are usually provided with respective circular gears in mesh with each other in use, whereby rotation of the traction wheel by the user in one direction causes rotation of the cutter blade in the opposite direction. In operation, the traction wheel engages the rim of a can from below, extending substantially parallel to the central or rotational axis of the can. The cutter blade penetrates completely through and cuts into the top wall of the can at a position slightly radially inwards of the rim, whereby the top wall is removable upon a complete revolution of the can about its central axis relative to the can opener. A disadvantage of this type of can openers is that metal cuttings and/or other contaminants on the outer surface of the top wall may fall into the can during opening. The cut away top wall is also difficult to remove as it may fall into the can.

Can openers of the second type have a traction wheel and a cuter blade whose axes of rotation are substantially parallel to each other, in that the wheel and the blade overlie one another to some extent when the can opener is in its operative condition. The traction wheel is rotatable by the user and the cutter blade is freely rotatable. In use, the traction wheel engages the radially inner surface of the rim of a can, with its axis of rotation substantially parallel to the central axis of the can. The cutter blade laterally penetrates completely through and cuts into the side wall of the can at a position slightly below the rim, whereby the top wall including the rim of the can are removable together upon a complete revolution of the can about its central axis relative to the can opener.

A can opener of the third type has been disclosed in UK Patent No. 2334939, which has a cutter blade so disposed relative to the traction wheel that in use, the cutter blade cuts into but not completely through the rim of the can. Cans are generally formed from a cylindrical metal body and two separate metal end walls, in that each end of the body and the outer edge of a respective end wall are folded together to form a sealed closure rim. The rim has five layers of metal when viewed in cross section, being a radially inner, a radially outer and a central layer of the end wall metal, and two intermediate layers of the body metal interlaced with the three layers of the end wall metal. A can opener incorporating a rim-cutting mechanism of this type is operable to cut laterally through the outermost layer of the rim. This results in the remainder of the end wall becoming releasable from the can body, thereby leaving a part of the rim in situ on the end wall and the other part of the rim in situ on the can body.

The present invention is directed to the second and third types of can openers, or collectively referred to as a laterally-cutting type, which at present are uncomfortable to use and especially awkward for left-handed users.

It is an object of the invention to overcome or at least reduce such problems.

SUMMARY OF THE INVENTION

According to a first aspect of the invention, there is provided a can opener of the laterally-cutting type, comprising a pair of operating members pivotal with respect to each other, one said member mounting a rotatable traction wheel and the other said member a rotatable cutter blade. The wheel and blade are movable between an inoperative position in which the wheel and the blade are spaced apart to an extent that the rim of a can to be opened is locatable between the wheel and the blade, and an operative position in which the wheel and the blade are in close proximity and engageable with the can to effect opening thereof, in which the traction wheel and the cutter blade have respective rotational axes which in use are substantially parallel to a central axis of the can. The can opener includes a housing formed on said one member, an operating element provided on one side of the can opener and supported by the housing and arranged to rotate about an axis generally transverse to the central axis of the can, and gearing provided in the housing mechanically coupling the operating element to the traction wheel.

Preferably, the gearing comprises two bevel gears.

For convenience of operation, the gearing is arranged to provide a mechanical advantage for the operating element.

It is preferred that the operating element is in the form of a butterfly knob.

In a preferred embodiment, the rotational axis of the operating element is inclined upwards at an angle in the range of 0° to 45° with respect to the plane of rotation of the traction wheel.

Specifically, the can opener is one of the third type as hereinafter defined.

According to a second aspect of the invention, there is provided a can opener of the laterally-cutting type, comprising a pair of operating members pivotal with respect to each other in use about a substantially vertical axis, one said member mounting a rotatable traction wheel and the other said member mounting a rotatable cutter blade. The wheel and the blade are movable between an inoperative position in which the wheel and the blade are spaced apart to an extent that the rim of a can to be opened is locatable between the wheel and the blade, and an operative position in which the wheel and the blade are in close proximity and engageable with the can to effect opening thereof. The can opener includes a housing formed on said one member, an operating element provided on one side of the can opener and supported by the housing and arranged to rotate about an axis generally transverse to the central axis of the can when the opener is in use on the can, and gearing provided in the housing mechanically coupling the operating element to the traction wheel.

Preferably, the gearing comprises two bevel gears.

For convenience of operation, the gearing is arranged to provide a mechanical advantage for the operating element.

It is preferred that the operating element is in the form of a butterfly knob.

In a preferred embodiment, the rotational axis of the operating element is inclined upwards at an angle in the range of 0° to 45° with respect to the plane of rotation of the traction wheel.

Specifically, the can opener is one of the third type as hereinafter defined.

According to a third aspect of the invention, there is provided a can opener of the laterally-cutting type, comprising a pair of operating members pivotal with respect to each other in use about a substantially vertical axis, one said member mounting a rotatable traction wheel and the other said member mounting a rotatable cutter blade. The wheel and the blade are movable between an inoperative position in which the wheel and the blade are spaced apart to an extent that the rim of a can to be opened is locatable between the wheel and the blade, and an operative position in which the wheel and the blade are in close proximity and engageable with the can to effect opening thereof. The can opener includes a housing formed on said one member, and an operating element provided on one side of the can opener and supported by the housing for rotating the traction wheel. Said one side of the opener is the left side to a user when the opener is used on the can by the user. The element is rotatable about an axis extending at an angle in the range of 45° to 90° downwards from the rotational axis of the traction wheel.

Preferably, the can opener further includes gearing provided in the housing mechanically coupling the operating element to the traction wheel.

More preferably, the gearing comprises two bevel gears.

For convenience of operation, the gearing is arranged to provide a mechanical advantage for the operating element.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
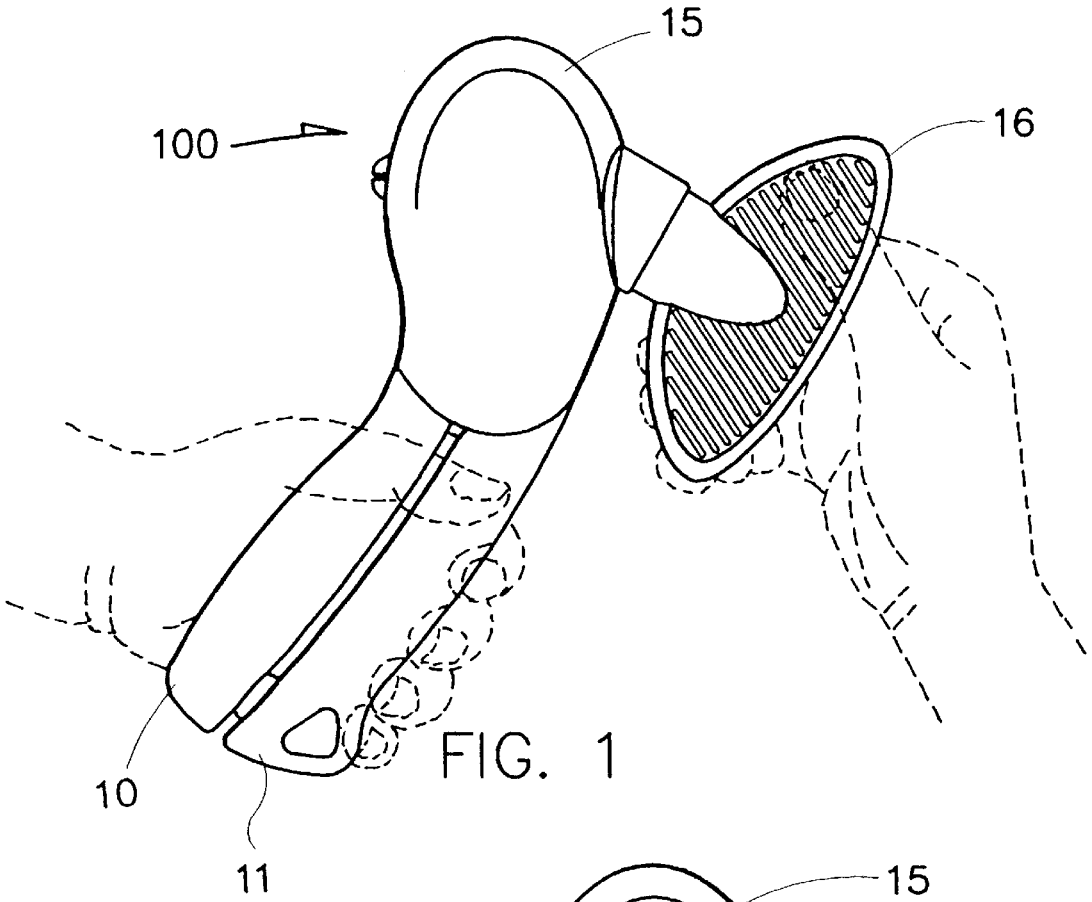
FIG. 1 is a top plan view of a first embodiment of a can opener in accordance with the invention, said can opener being for right-handed use.
Figure 6:
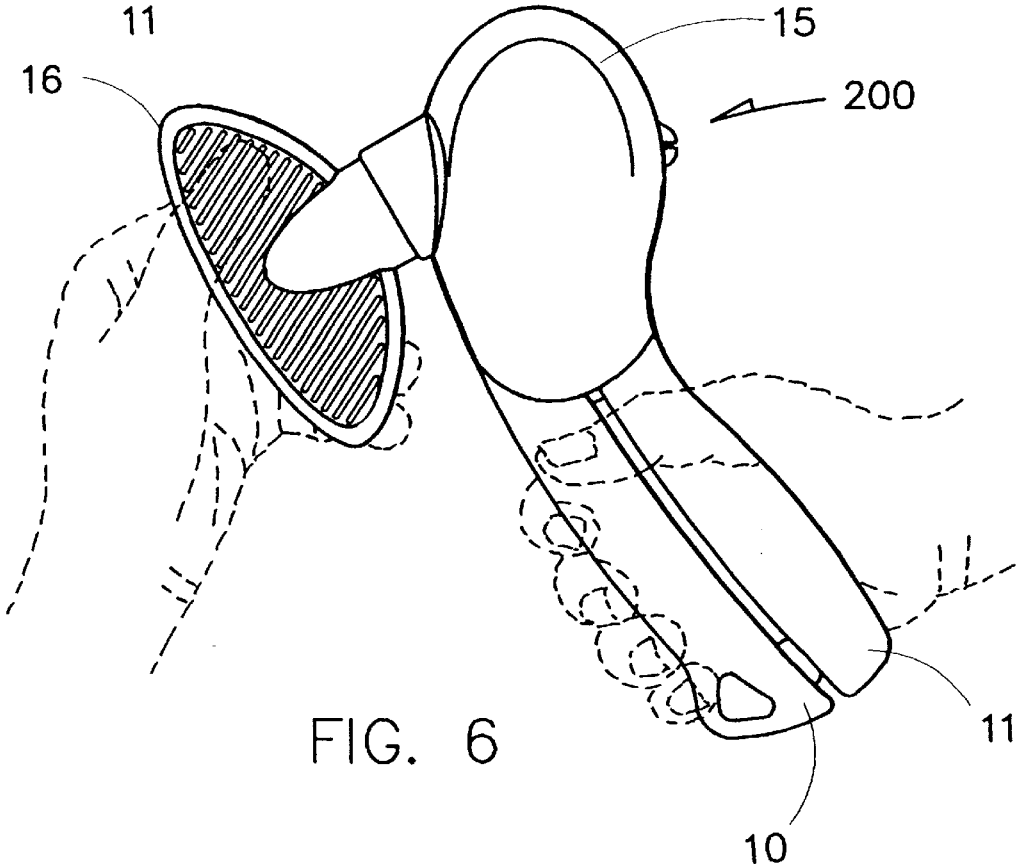
FIG. 6 is a top plan view of a second embodiment of a can opener in accordance with the invention, said can opener being for left-handed use.

Referring initially to FIGS. 1 to 10 of the drawings, there are shown a right-handed can opener 100 (FIGS. 1 to 5) and a left-handed can opener 200 (FIGS. 6 to 10) embodying the invention, which have very similar constructions and belong to the aforesaid laterally-cutting type in general or more specifically the third type as disclosed in UK Patent No. 2334939. Each can opener 100/200 has a pair of operating members in the form of handles 10 and 11, which are connected together for pivotal movement relative to each other in use about a substantially vertical axis. The handles 10 and 11 mount, at their front ends, a traction wheel 13 and a circular cutter blade 14 (in a cylindrical assembly) respectively for rotation about separate generally vertical axes such that, upon pivoting close together, a rim of a can 12 gripped by and between the traction wheel 13 and the cutter blade 14 can be cut open by the blade 14.

An operating element, in the form of a butterfly knob 16, is connected indirectly to an axle 13A of the traction wheel 13 (directly in the case of known constructions), which is turned to rotate the can 12 relative to the can opener 100/200. As a result, an outermost layer of the rim is cut open so that the top wall concerned or the lid so formed can be removed from the body of the can 12.

For either can opener 100/200, the handle 10 includes a front end housing 15 which rotatably supports the operating knob 16 on one side. The knob 16 is indirectly connected to the traction wheel 13 by means of a pair of bevel gearwheels 17 and 18 mounted within the housing 15.

In the case of the can opener 100, the operating knob 16 is provided on the right hand side of the can opener 100 for use by a right-handed user. The first gearwheel 17 is connected directly to an axle 16A of the operating knob 16, and the second gearwheel 18 directly to the axle 13A of the traction wheel 13. The second gearwheel 18 is positioned on the lower side of the first gearwheel 17, for suiting the cutting direction of the cutter blade 14 as determined by its rotational axis being inclined at substantially 6° from the rotational axis of the traction wheel 13 as disclosed in UK Patent No. 2334939.

For the other can opener 200, the operating knob 16 is provided on the left hand side to suit a left-handed user. The gearwheels 17 and 18 are likewise connected directly to the knob axle 16A and the wheel axle 13A, respectively. However, the second gearwheel 18 is positioned on the upper side of the first gearwheel 17, such that the same arrangement of the traction wheel 13 and cutter blade 14, instead of a mirror image arrangement, can be employed in this can opener 200 for use by a left-handed user.

By reason of the use of the gearwheels 17 and 18, the rotational axis of the operating knob 16 extends transversely to the central axis of the can 12. This allows in use for comfortable manual turning of the operating knob 16 by a right-handed or left-handed user respectively, in a position where his/her forearm can turn about a generally transverse or horizontal axis for opening the can 12. Compared with conventional can openers of the same type in which the operating knob is rotatable about the same axis as the traction wheel, the gearwheels 17 and 18 serve to incline the rotational axis of the knob 16 from that of the traction wheel 13 for enhanced comfort in operation.

In addition, as the driving gearwheel 17 has a relatively smaller number of teeth than that of the driven gearwheel 18, a mechanical advantage is provided so that the traction wheel 13 and cutter blade 14 can comparatively easy be turned, as required, by a user.

Figure 11:
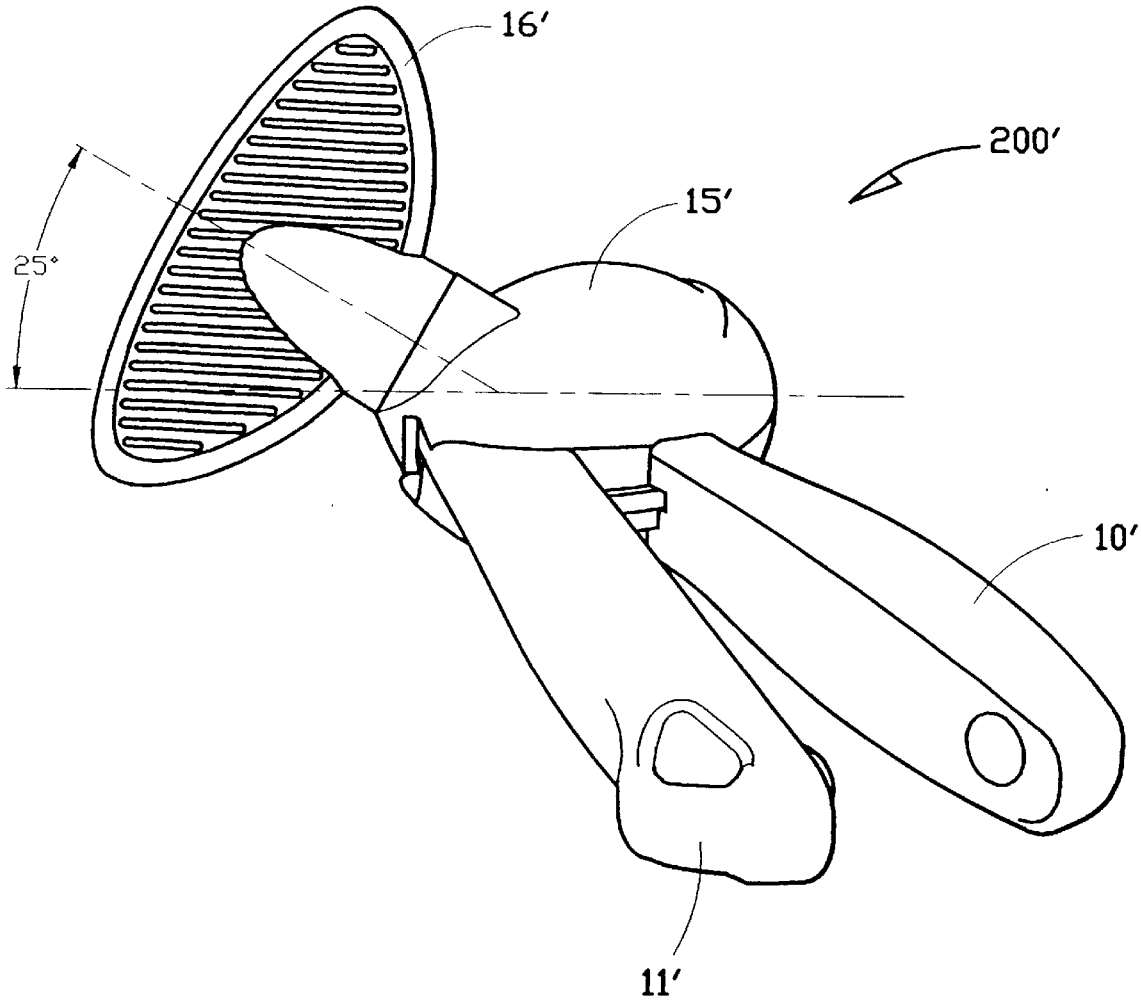
FIG. 11 is a rear end perspective view of a slightly different can opener, which is based on the can opener of FIG. 6.
Figure 12:
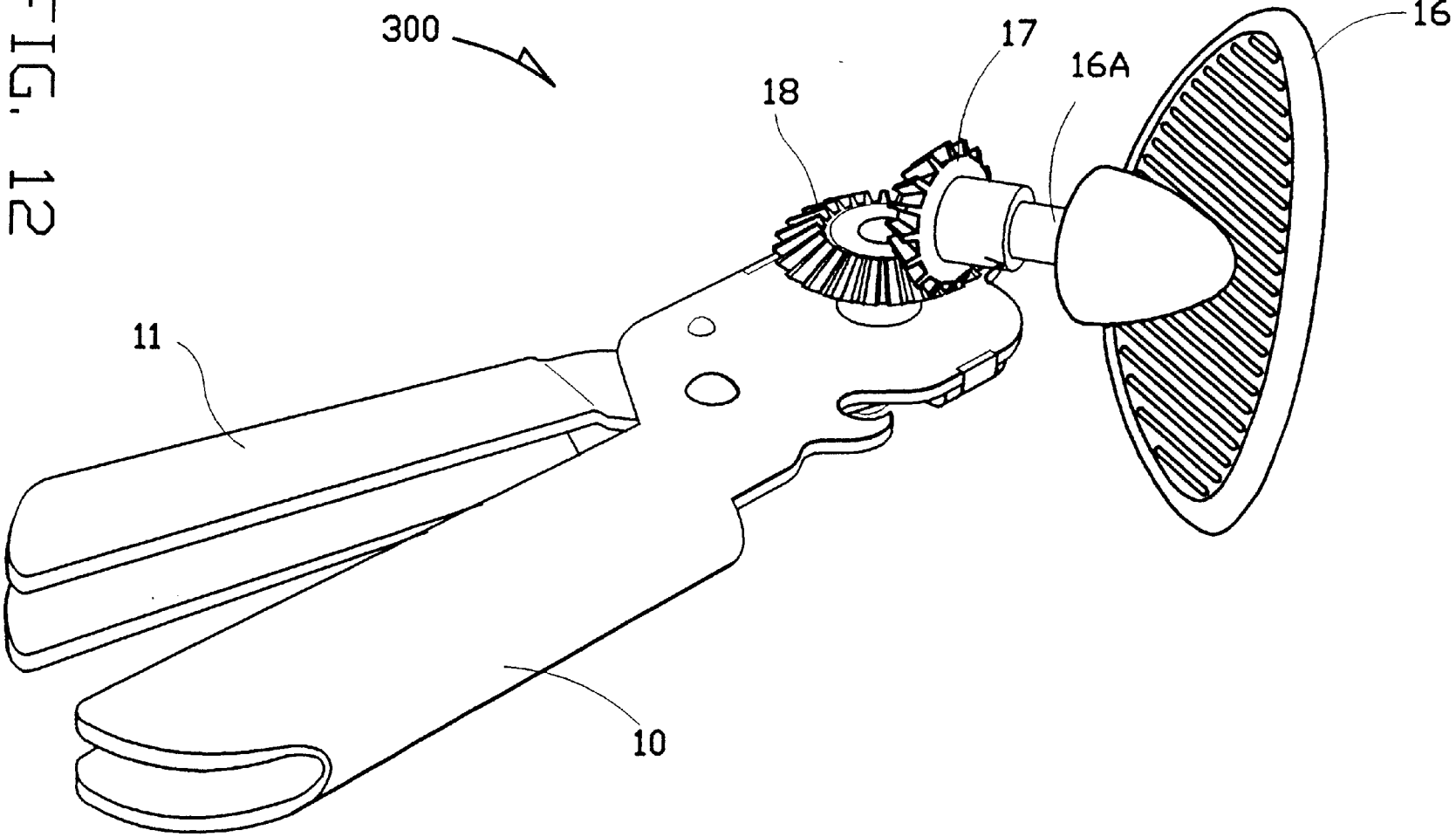
FIG. 12 is a rear end perspective view of a third embodiment of a can opener in accordance with the invention, said can opener being for right-handed use.
Figure 13:
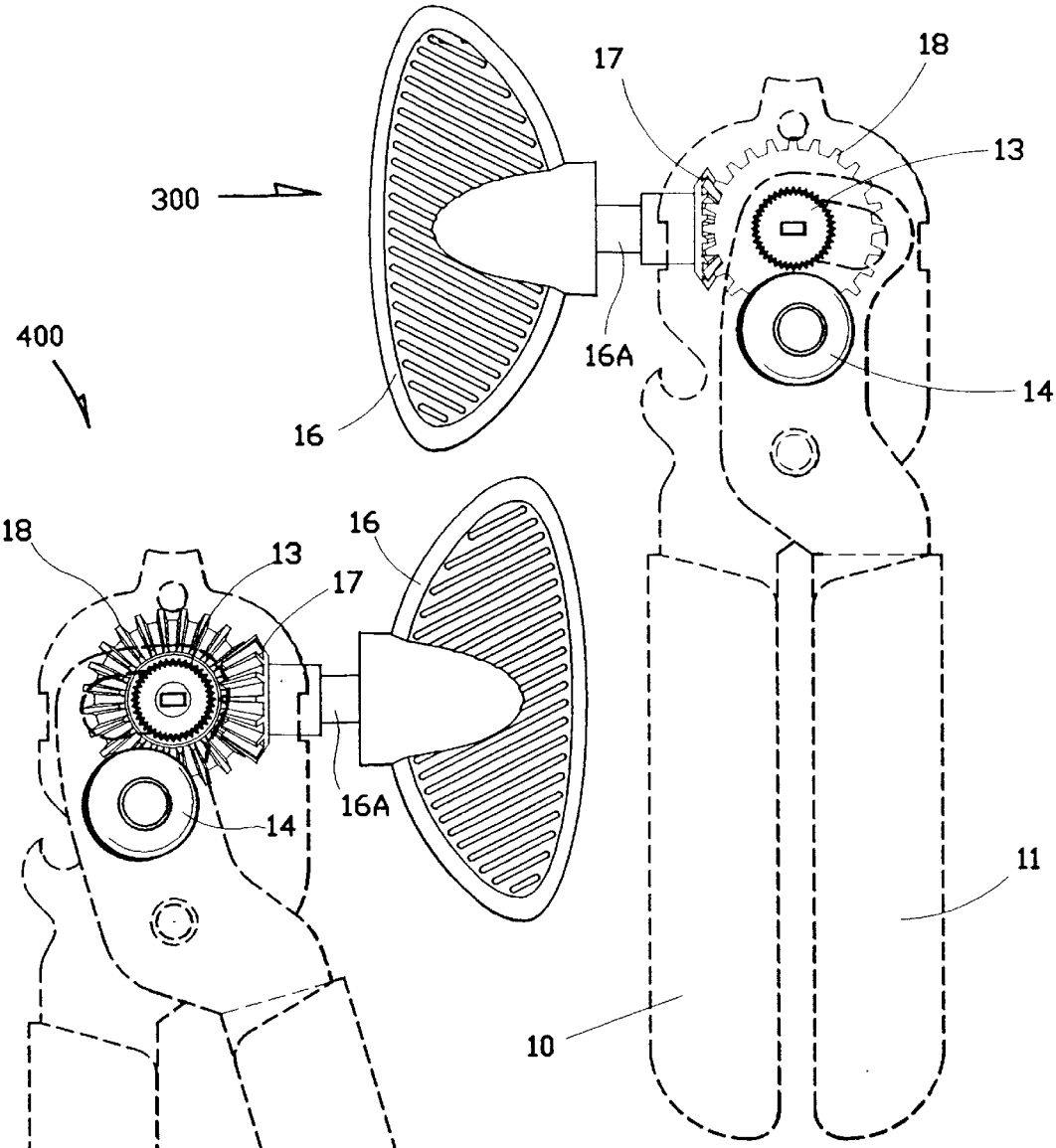
FIG. 13 is a bottom plan view of the can opener of FIG. 12.
Figure 16:
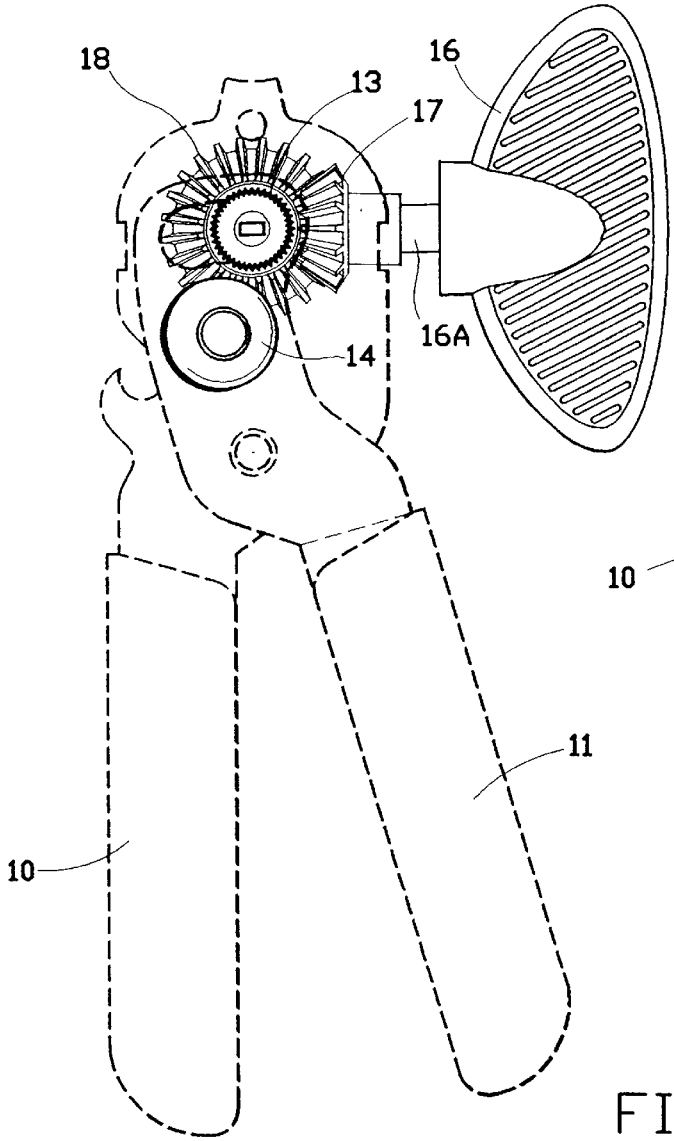
FIG. 16 is a bottom plan view of a fourth embodiment of a can opener in accordance with the invention, said can opener being for left-handed use.
Figure 14:
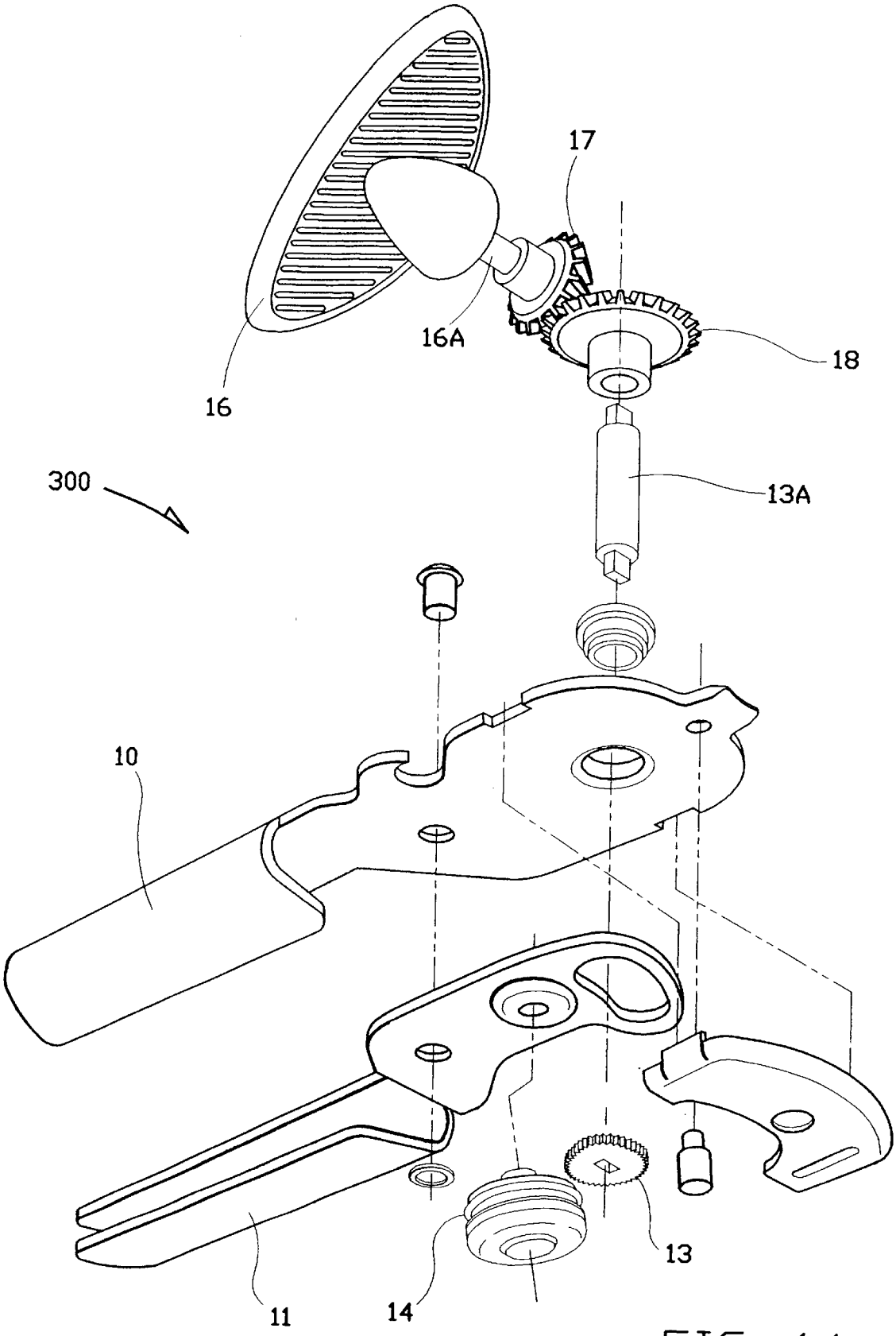
FIG. 14 is an exploded perspective view of the can opener of FIG. 12.
Figure 15:
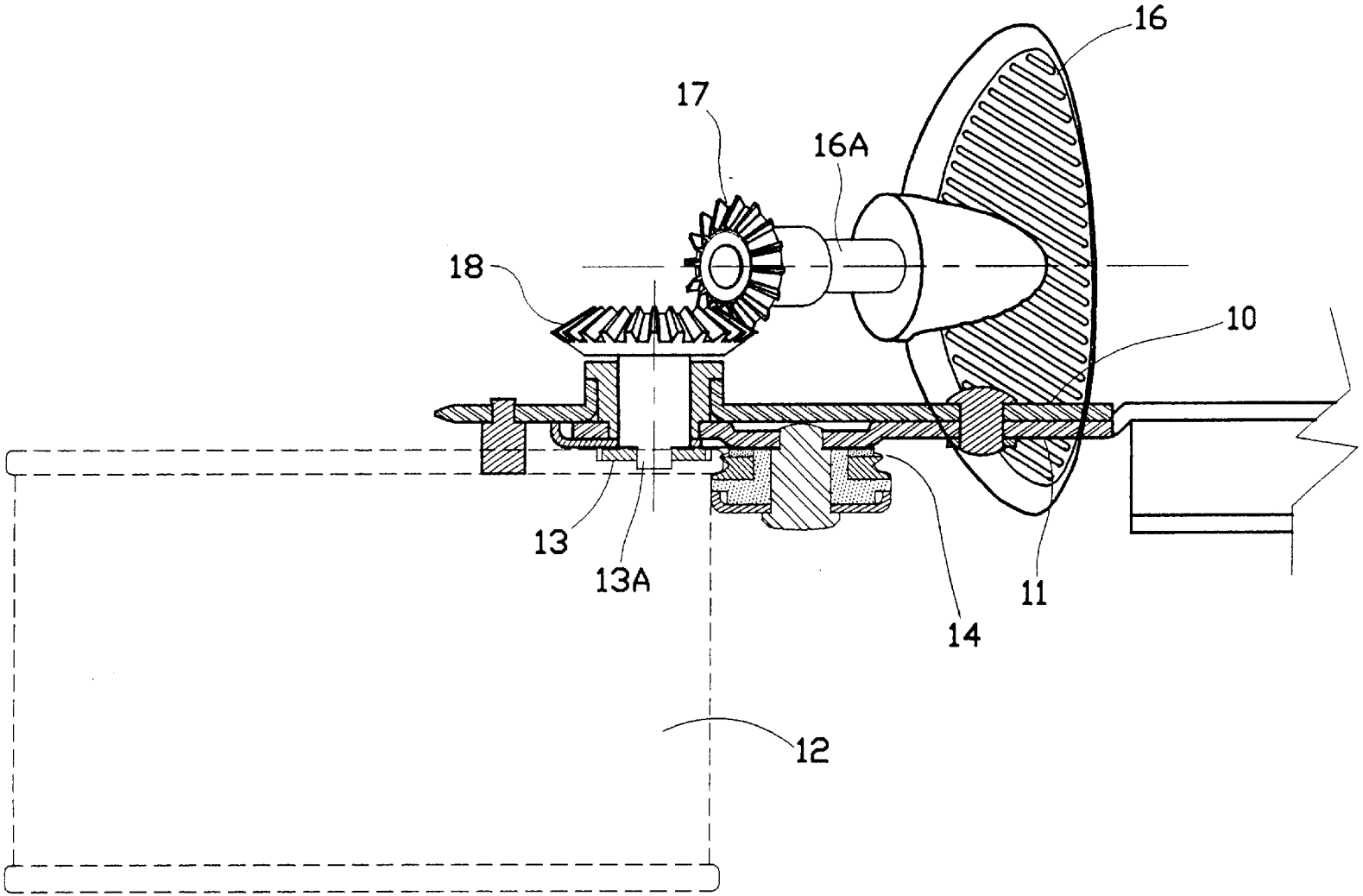
FIG. 15 is a cross-sectional side view of the can opener of FIG. 12, shown in operation cutting open a can.
Figure 17:
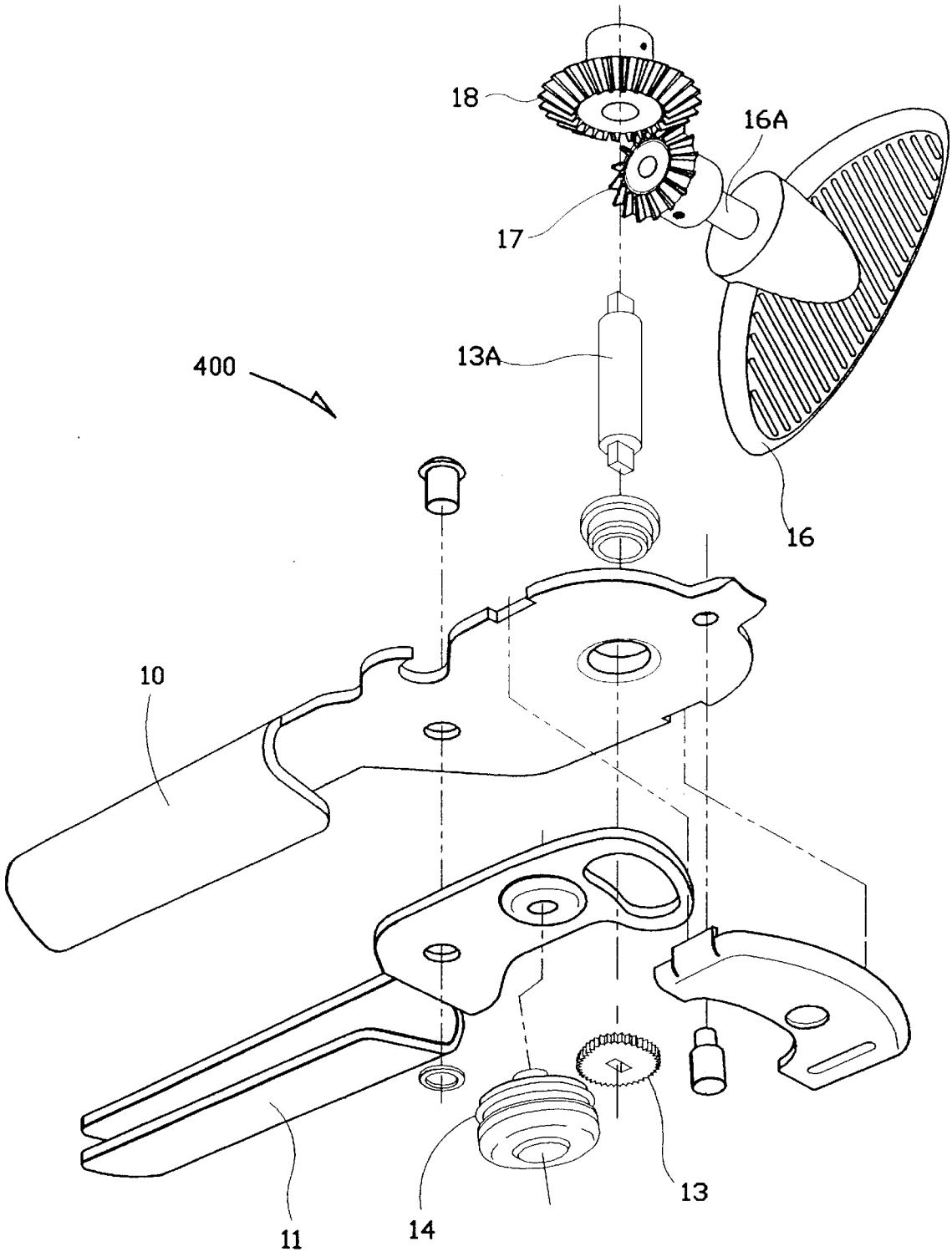
FIG. 17 is an exploded perspective view of the can opener of FIG. 16.

A slightly different can opener 200' is shown in FIG. 11, which has been changed based on the can opener 200, with equivalent parts designated by the same reference numerals suffixed by an apostrophe. In this can opener 200', as compared with the earlier can opener 200, the major difference lies in the axis of rotation of the operating knob 16' being inclined about 25° upwards with respect to a plane of rotation of the traction wheel 13'.

Figure 2:
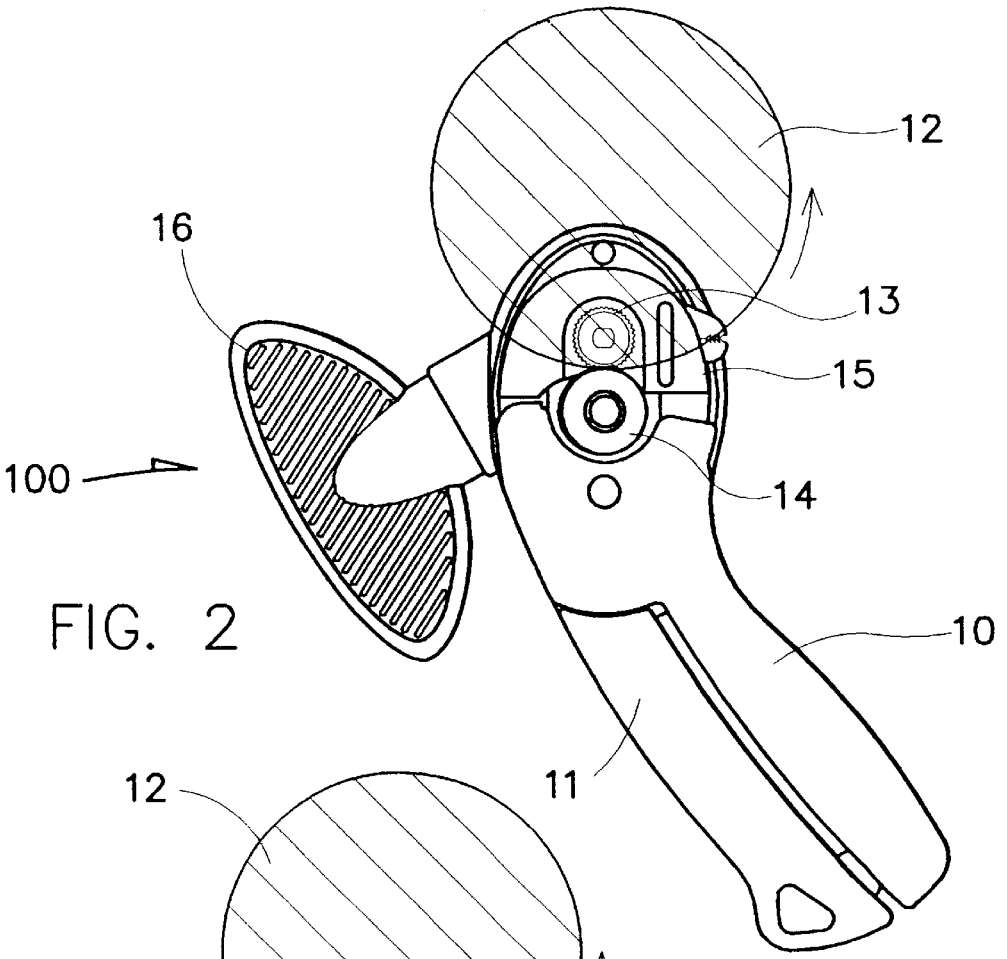
FIG. 2 is a bottom plan view of the can opener of FIG. 1, shown in operation cutting open a can.
Figure 7:
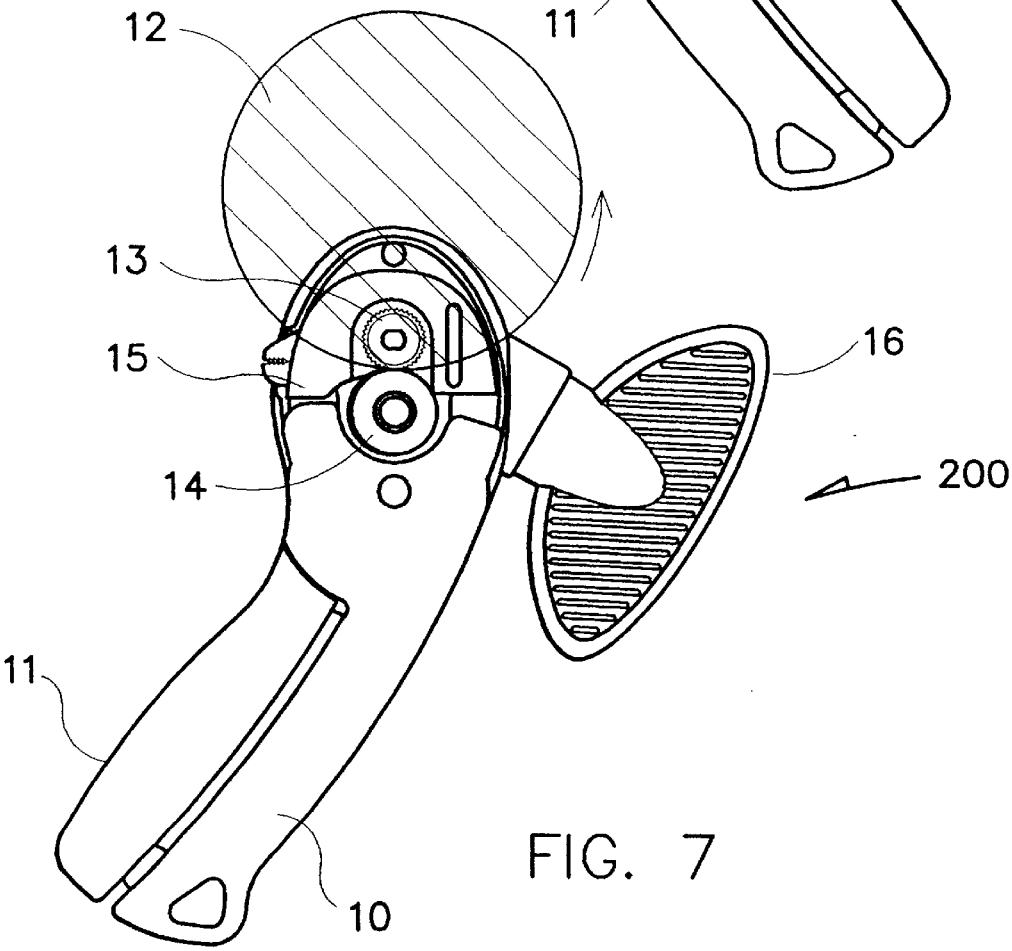
FIG. 7 is a bottom plan view of the can opener of FIG. 6, shown in operation cutting open a can.
Figure 3:
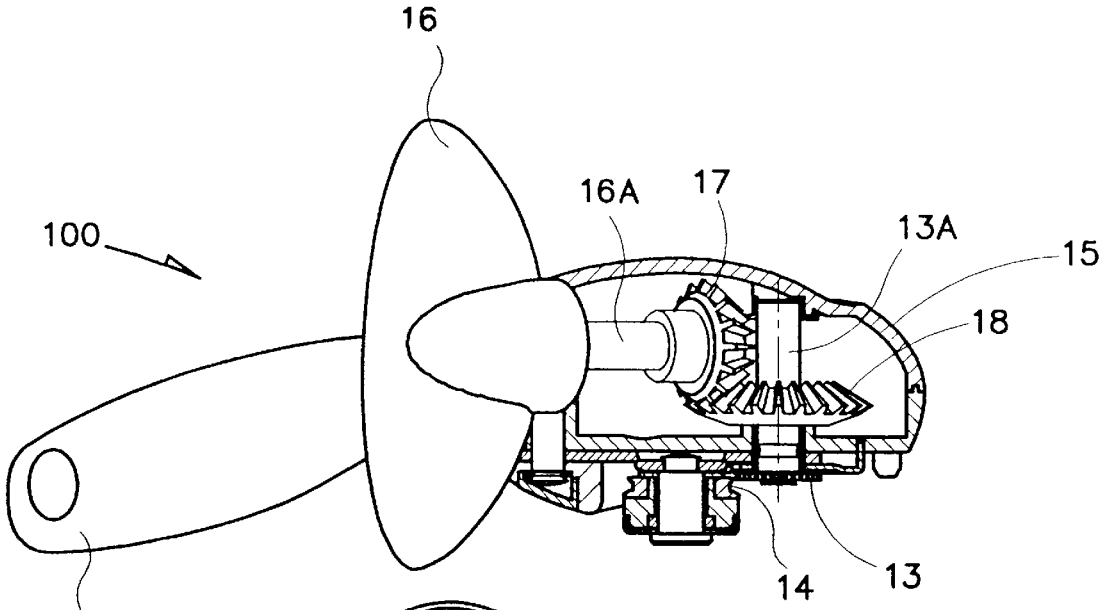
FIG. 3 is a cross-sectional front end view of the can opener of FIG. 1.
Figure 4:
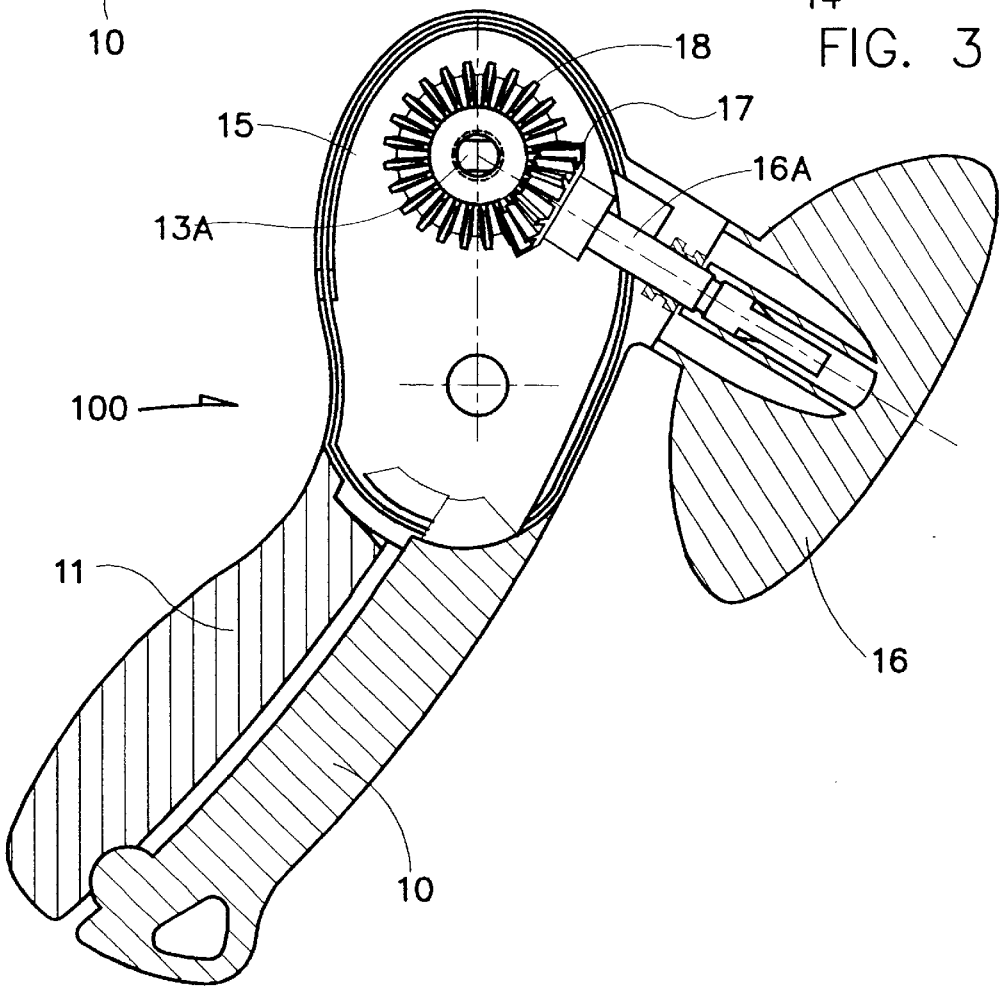
FIG. 4 is a cross-sectional top plan view of the can opener of FIG. 1.
Figure 5:
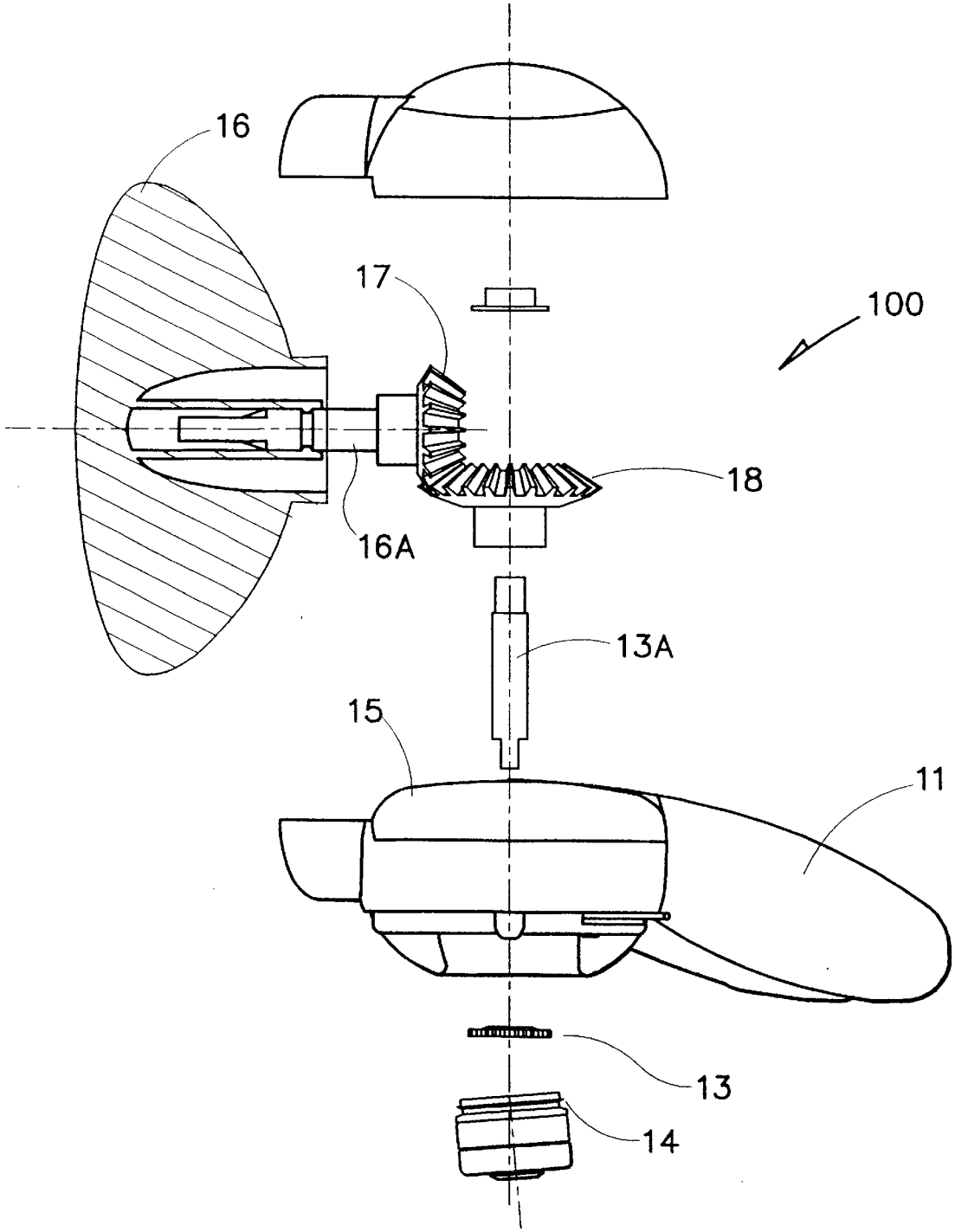
FIG. 5 is an exploded front end view of the can opener of FIG. 1.
Figure 8:
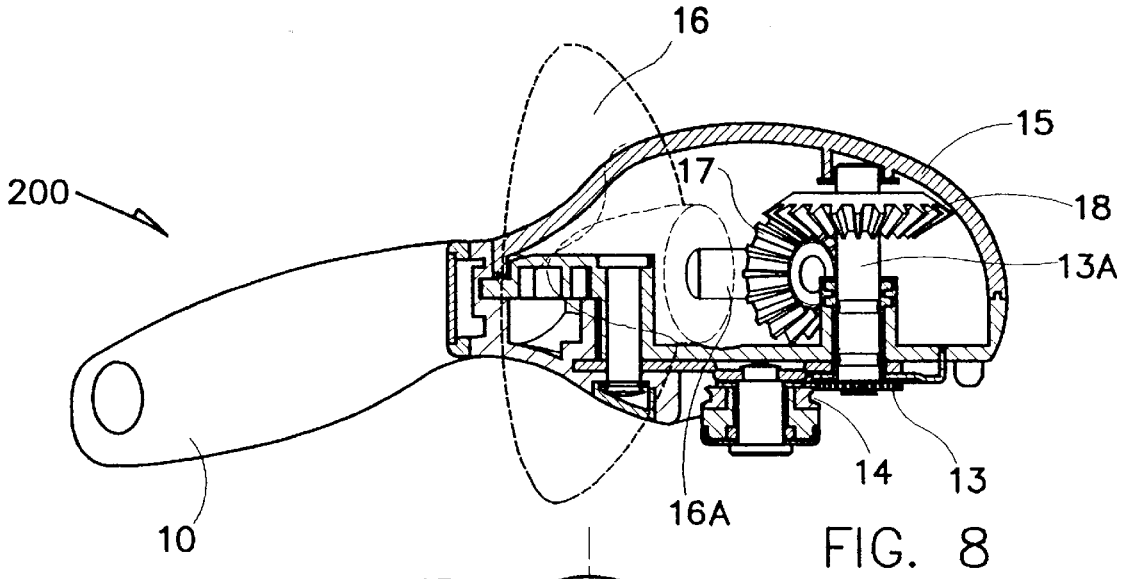
FIG. 8 is a cross-sectional front end view of the can opener of FIG. 6.
Figure 9:
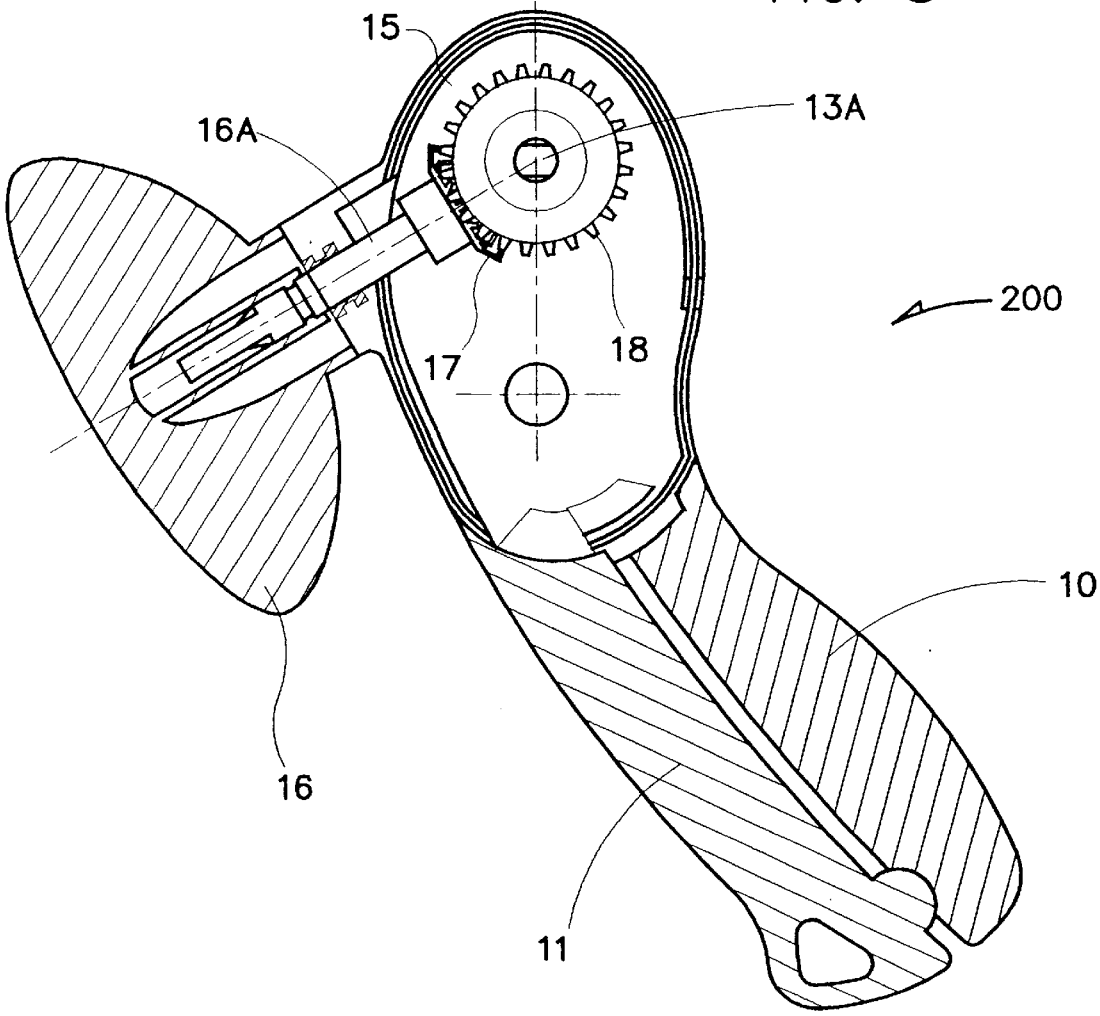
FIG. 9 is a cross-sectional top plan view of the can opener of FIG. 6.
Figure 10:
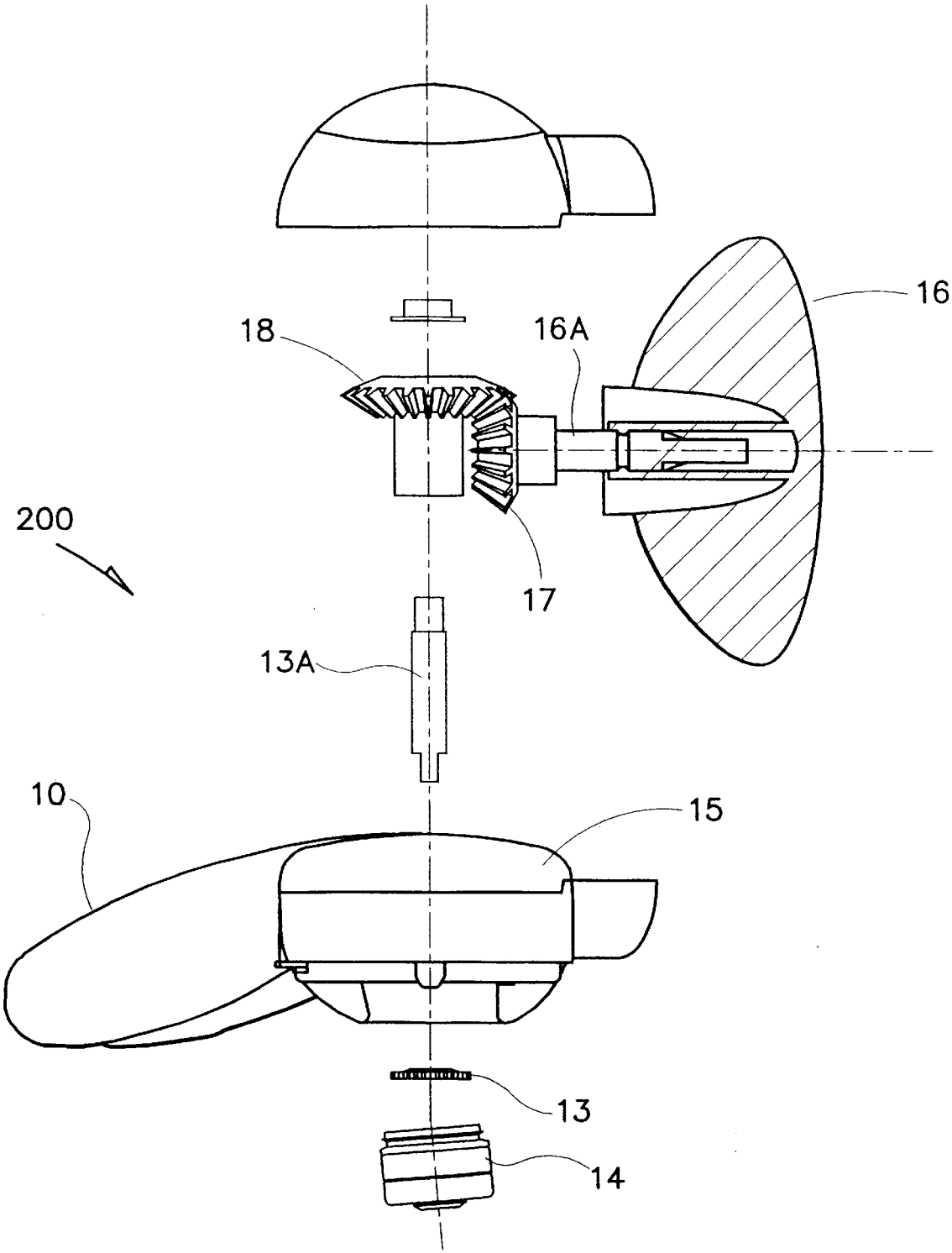
FIG. 10 is an exploded front end view of the can opener of FIG. 6.

As a result, the wings of the knob 16' are in effect raised upwards, so that the knob 16' can be rotated completely above the top surface plane of the can 12 without fouling the top surface. If the can 12 is circular as shown in FIGS. 2 and 7, such an uplifted operational position may not be required. However, for a laterally oval or rectangular can, the wings of the knob 16' may otherwise, during use, come into contact with the top surface of the can.

It is to be appreciated that tilting of the axis of rotation of the knob 16' upwards from the plane of rotation of the traction wheel 13, for an angle of 25° as shown in FIG. 11, does not impair to any great extent the overall or other advantages as provided by embodiments of the invention, that is to say it does make the turning of the knob 16' much, if any, more awkward in use. In general, the rotational axis of the knob 16/16' may be tilted upwards from the plane of rotation of the traction wheel 13 for an angle in the range of 0° to 45°, or in other words downwards from the rotational axis of the traction wheel 13 in the range of 45° to 90°.

Reference is finally made to FIGS. 12 to 17 of the drawings, which show another right-handed can opener 300 (FIGS. 12 to 15) and another left-handed can opener 400 (FIGS. 16 and 17) embodying the invention, which belong to the aforesaid laterally-cutting type in general or more specifically the third type as disclosed in UK Patent No. 2334939. The construction of the can openers 300/400 is conceptually very similar to that of the earlier can openers 100/200, with equivalent parts designated by the same reference numerals. Save for the gearing as shown (equivalent to the earlier gearwheels 17 and 18) and a housing therefor not shown (equivalent to the earlier housing 15), the construction of the other or like components has been fully described in UK Patent No. 2334939 and their inter-relationship and operation will be well understood by persons skilled in the art.

It will be appreciated that the described embodiments of the invention, comprising the so-called laterally-cutting type in general or more specifically the third type of can openers as defined above, are therefore generally much more comfortable to use and, as is apparent from the description and drawings, readily assembled for either a left-handed or a right-handed user, making use of the same or virtually exactly the same components for assembling left-handed and right-handed can openers.

It is envisaged that the subject invention may equally be applied to can openers of the second type, in that the cutter blade 14 should be lowered (slightly) to a position for cutting into the side wall of a can, right below the rim, so that the whole of the top periphery of the can becomes removable.

It will be noted, as mentioned above and/or shown in the drawings, that the rotational axis of cutter blade 14 is off-set by a small angle of about 6° with respect to that of the traction wheel 13 or the can 12, to improve the cutting action. It has also been proposed to off-set the rotational axis of the traction wheel 13 by a few degrees to improve surface gripping against the rim of the can 12 in use. Thus, where the term "substantially parallel" is used in the specification in relation to the axes of the traction wheel, the cutter blade and/or the can, it is intended to encompass appropriate off-set angles in the range of 3° to 10°.

The invention has been given by way of example only, and various other modifications of and/or alterations to the described embodiments may be made by persons skilled in the art without departing from the scope of the invention as specified in the appended claims.

What is claimed is:

1. A can opener comprising:

first and second operating members pivotable with respect to each other about a common axis, a rotatable traction wheel mounted on said first operating member, a rotatable cutter blade mounted on said second operating member, said first operating member and said second operating member being movable between an inoperative position in which said traction wheel and said cutter blade are spaced apart so that a rim of a can to be opened may be located between said traction wheel and said cutter blade, and an operative position in which said traction wheel and said cutter blade engage a can for opening the can, a housing on said first operating member, and an operating element on one side of said can opener and supported by said housing for rotating said traction wheel, said operating element including a butterfly knob rotatable about an axis oblique to a rotational axis of said traction wheel wherein said butterfly knob does not, upon rotation, contact a can being opened by said can opener.

2. The can opener as claimed in claim 1, further including gearing in said housing mechanically coupling said operating element to said traction wheel.

3. The can opener as claimed in claim 2, wherein said gearing comprises a first bevel gear coupled to and rotating said operating element and a second bevel gear engaging the first bevel gear and coupled to and rotating said traction wheel.

4. The can opener as claimed in claim 3, wherein said first bevel gear has fewer teeth than second bevel gear, providing a mechanical advantage for said operating element.

5. A can opener as claimed in claim 1, wherein the rotational axis of said operating element is inclined at an angle of approximately 25° with respect to the plane of rotation of said traction wheel.

6. The can opener as claimed in claim 1, wherein said traction said cutter blade have respective rotational axes substantially parallel to a central axis of a can being opened.

7. A can opener comprising:

first and second operating members pivotable with respect to each other about a common axis, a rotatable traction wheel mounted on said first operating member, a rotatable cutter blade mounted on said second operating member, said first operating member and said second operating member being movable between an inoperative position in which said traction wheel and said cutter blade are spaced apart so that a rim of a can to be opened may be located between said traction wheel and said cutter blade, and an operative position in which said traction wheel and said cutter blade engage a can for opening the can, a housing on said first operating member, an operating element on one side of said can opener, supported by said housing, and rotatable about an axis for rotating said traction wheel, wherein the rotational axis of said operating element is inclined with respect to a plane of rotation of said traction wheel, and gearing in said housing mechanically coupling said operating element to said traction wheel and including a first bevel gear coupled to and rotated by said operating element and a second bevel gear engaging said first bevel gear and coupled to and rotating said traction wheel upon rotation of said operating element, said first bevel gear having fewer teeth than said second bevel gear so that a mechanical advantage is provided for said operating element.

8. The can opener as claimed in claim 7, wherein said traction wheel and said cutter blade have respective rotational axes substantially parallel to a central axis of a can being opened.

9. The can opener as claimed in claim 7, wherein said operating element includes a butterfly knob.

10. A can opener as claimed in claim 7, wherein the rotational axis of said operating element is inclined at an angle of approximately 25° with respect to the plane of rotation of said traction wheel.

* * * * *